US008169372B1

(12) United States Patent
Tam

(10) Patent No.: US 8,169,372 B1
(45) **Date of Patent: *May 1, 2012**

(54) ELECTROLYTIC FLUID ANTENNA

(75) Inventor: Daniel W. S. Tam, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 55 days.

This patent is subject to a terminal disclaimer.

(21) Appl. No.: 13/012,575

(22) Filed: Jan. 24, 2011

Related U.S. Application Data

(63) Continuation of application No. 12/119,302, filed on May 12, 2008, now Pat. No. 7,898,484.

(51) Int. Cl.
*H01Q 1/26* (2006.01)

(52) U.S. Cl. ..... 343/701; 343/788

(58) Field of Classification Search ..... 343/709, 343/710, 701, 788
See application file for complete search history.

(56) References Cited

U.S. PATENT DOCUMENTS

| | | | | |
|---|---|---|---|---|
| 4,498,086 | A | 2/1985 | Sandler | |
| 5,633,648 | A * | 5/1997 | Fischer | 343/788 |
| 6,492,956 | B1 * | 12/2002 | Fischer et al. | 343/788 |
| 6,674,970 | B1 * | 1/2004 | Anderson | 398/121 |
| 6,859,189 | B1 | 2/2005 | Ramirez et al. | |
| 7,262,734 | B2 * | 8/2007 | Wood | 343/701 |
| 2004/0060162 | A1 | 4/2004 | Moren | |

OTHER PUBLICATIONS

Fayad, H. and Record, P., Broadband Liquid Antenna, Feb. 2, 2006, Electronic Letters, vol. 42, No. 3.*
David H. Hatch; The "ILA"—Ionic Liquid Antenna Concept by N9ZRT; Nov. 27, 2002, available on the internet at http://www.wireservices.com/n9zrt/ila/ila.html.
Unpublished U.S. Appl. No. 11/867,041, filed Oct. 4, 2007 by Daniel Tam et al., titled "Muitiband Current Probe Fed Antenna."
Michael Stewart, The Ship as Antenna; Military Information Technology Online Archives, vol. 8, Issue 10, Dec. 22, 2004.
John H Meloling, James H. Schukantz Jr., & Joseph Fischer; A Transmit Mast-Clamp Current Probe for Shipboard HF Communications; IEEE 0-7803-8883-6/05. pp. 17-20, 2005.
Fayad, H.; Record, P.; Broadband Liquid Antenna, Electronics Letters, vol. 42, Issue 3, Feb. 2, 2006 pp. 133-134.
Ewananovil Parascrakis, Hazem Fayad, Paul Record; Ionic Liquid Antenna; Small Antennas and Novel MetaMaterials pp. 252-254, IEEE, 0-7803-8842-9/05/S, 2005.

* cited by examiner

*Primary Examiner* — Jacob Y Choi
*Assistant Examiner* — Kyana R McCain
(74) *Attorney, Agent, or Firm* — Kyle Eppele; J. Eric Anderson

(57) ABSTRACT

An antenna comprising: a first current probe comprising a core of ferromagnetic material having an aperture therein; a pump comprising a nozzle, wherein the pump is configured to pump a free-standing stream of electrolytic fluid out the nozzle and through the aperture such that the stream and the current probe are magnetically coupled; and a first transceiver operatively coupled to the current probe.

16 Claims, 9 Drawing Sheets

ELECTROLYTIC FLUID ANTENNA

CROSS-REFERENCE TO RELATED APPLICATION

This application is a Continuation of U.S. application Ser. No. 12/119,302, filed 12 May 2008, now U.S. Pat. No. 7,898,484 "Electrolytic Fluid Antenna" (Navy Case #98582). The subject matter of this application relates to the subject matter disclosed in U.S. application Ser. No. 11/867,046, filed 4 Oct. 2007, entitled "Multi-band Current Probe Fed Antenna" (Navy Case #84943), which is incorporated by reference herein in its entirety for its teachings.

FEDERALLY-SPONSORED RESEARCH AND DEVELOPMENT

This invention is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-2778; email T2@spawar.navy.mil. Reference Navy Case Number 100954.

BACKGROUND OF THE INVENTION

With increasing numbers of wireless communications systems available today, more and more antennas are required to support them. In many situations the available real estate for placement of antennas is limited. For example, the area available on building rooftops, and exterior surfaces of automobiles, aircraft, and sea craft, which often serve as antenna placement locations, is particularly limited, especially in scenarios where multiple antennas are desired. A need exists for an antenna with a relatively small footprint.

BRIEF DESCRIPTION OF THE DRAWINGS

Throughout the several views, like elements are referenced using like references.

DETAILED DESCRIPTION OF EMBODIMENTS

Figure 1:
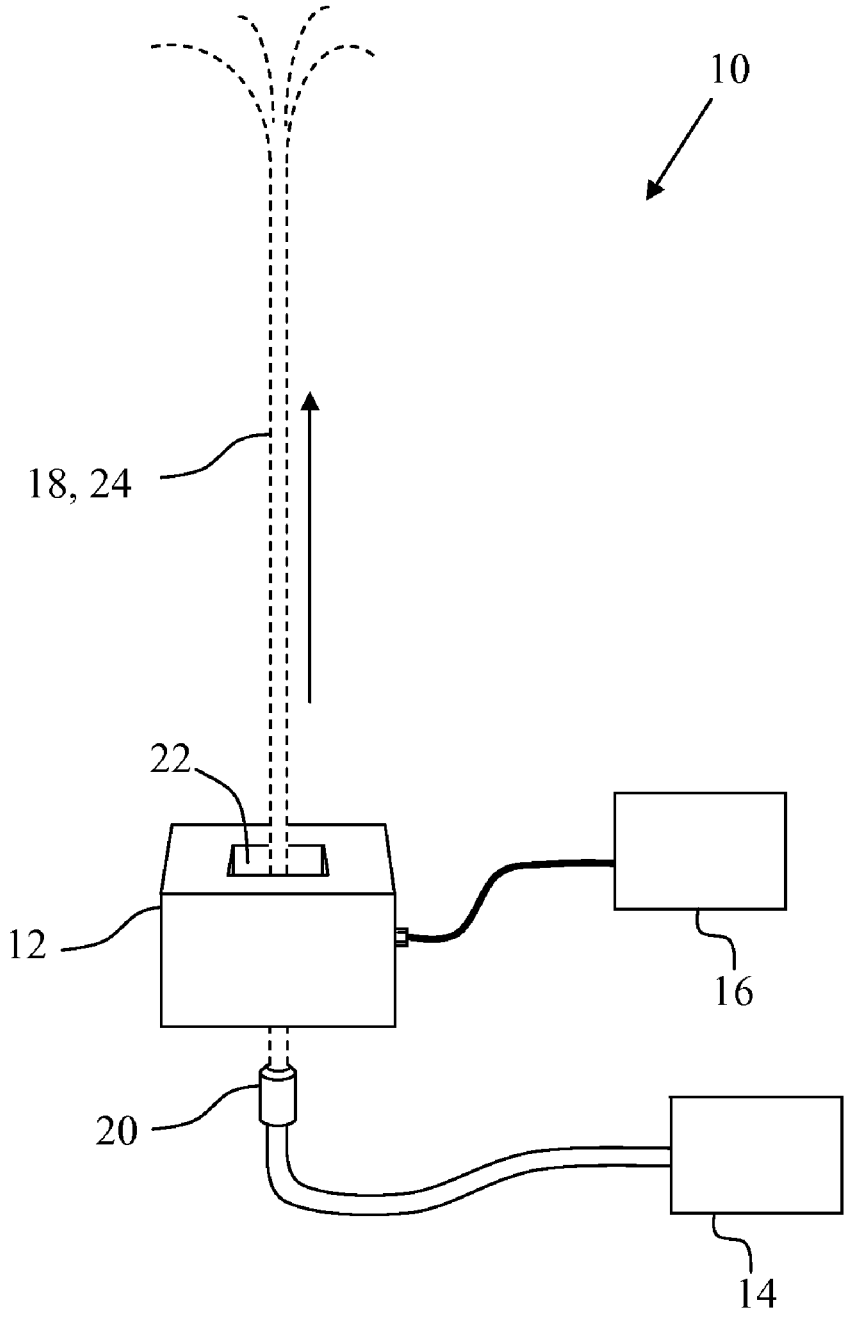
FIG. 1 is a perspective view of the electrolytic fluid antenna.

FIG. 1 shows an embodiment of an electrolytic fluid antenna 10 that comprises a a first current probe 12; a pump 14, and a first transceiver 16. The pump 14 is configured to pump electrolytic fluid 18 out a nozzle 20 and through an aperture 22 in the first current probe 12. The first transceiver 16 is operatively coupled to the current probe 12. Pumping the electrolytic fluid 18 out the nozzle 20 and through the aperture 22 creates a continuous stream 24 that functions as the antenna element thereby, effectively creating an antenna capable of receiving and/or transmitting electromagnetic signals. The electrical length of the electrolytic fluid antenna 10 may be varied continuously by pumping electrolytic fluid 18 high or low enough to get any desired wavelength.

Regarding current probe antennas in general, the antenna voltage is the product of the effective length of the antenna times the incident electric field. An incoming radio frequency (RF) signal may be considered as the incident electric field. The antenna voltage divided by the self-impedance of the antenna governs the antenna current. The movement of the antenna current generates the H magnetic field, which is picked up by the current probe. The magnetic flux density, or B field, in the current probe is generated by the H field and amplified by the permeability $\mu$ of the ferrite core of the current probe. The magnetic flux $\Phi$ in the ferrite core is produced by the cross section of the ferrite core and the B field. The changing magnetic flux $\Phi$ produces the voltage output by the one-turn loop on the ferrite core.

The electrolytic fluid 18 utilized in the electrolytic fluid antenna 10 may be any electrolytic fluid with an electrical conductivity of at least approximately 5 Siemens per meter. A suitable example of the electrolytic fluid 18 is seawater. The electric currents in seawater are flows of electrically charged atoms (sodium ions). When seawater is used in the electrolytic fluid antenna 10, the movement of the sodium ions in the stream 24 allows electric current conduction for signal reception and transmission. The length and diameter of the stream 24 determine the impedance of the electrolytic fluid antenna 10. The length determines the frequency of the electrolytic fluid antenna 10 and the thickness of the diameter of the stream 24 determines the bandwidth of the electrolytic fluid antenna 10. Although reference is made to the diameter of the stream 24, it is to be understood that the cross-section of the stream 24 need not be circular, but that the stream 24 may have any cross-sectional shape.

The first current probe 12 comprises a ferrite core and a nonmagnetic, metallic housing. The ferrite core has the shape of a toroid or its topological equivalent. The first current probe 12 may be designed to transmit and/or receive in any given operating band. For example, an embodiment of the electrolytic fluid antenna 10 may comprise a first current probe 12 designed to transmit and receive in the High Frequency (HF) range (2-100 MHz). The current probe 12 may be positioned with respect to the stream 24 such that the current probe 12's voltage standing wave ratio (VSWR) is less than or equal to approximately its operating frequency range VSWR requirement of the first transceiver 16. For example, the current probe 12's VSWR may be less than or equal to approximately 3:1.

Figure 2:
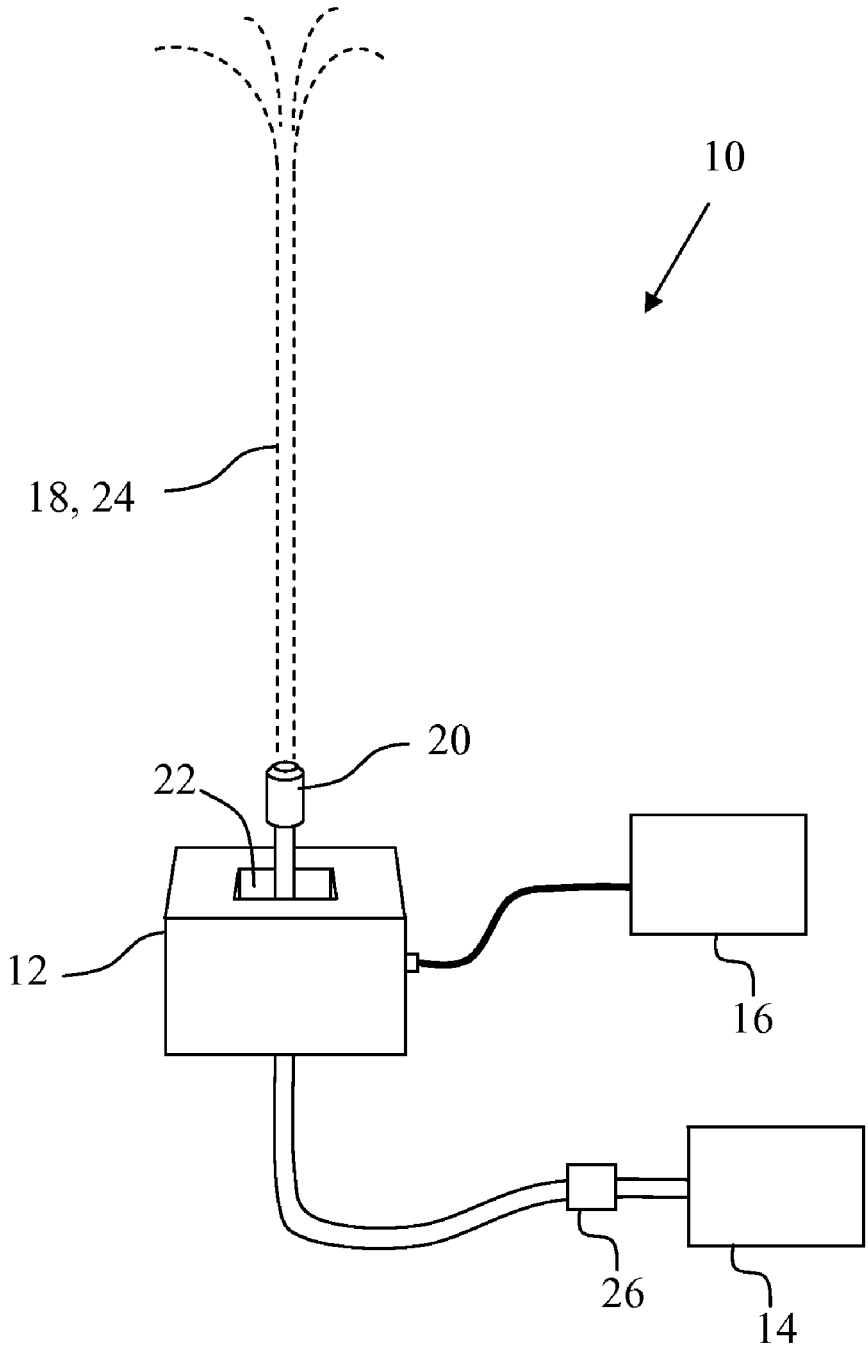
FIG. 2 is a perspective view of an embodiment of the electrolytic fluid antenna including a pressure regulator.

FIG. 2 shows another embodiment of the electrolytic fluid antenna 10 further comprising a pressure regulator 26 operatively coupled to the pump 14. The pressure regulator 26 is configured to alter the pressure of the electrolytic fluid 18 between the pump 14 and the nozzle 20; thereby altering the length of the stream 24 of electrolytic fluid 18. Different stream 24 lengths produce different electrical lengths that cause different resonant frequency responses of the electrolytic fluid antenna 10. The size and shape of the nozzle 20 may also be altered to change the size and shape of the stream 24. The nozzle 20 may be positioned in any manner that allows the electrolytic fluid 18 to pass through the aperture 22. For example, the embodiment of the electrolytic fluid antenna 10 shown in FIG. 1 shows the nozzle 20 below the current probe 12. FIG. 2 shows another example embodiment of the electrolytic fluid antenna 10 with the nozzle 20 above the current probe 12. FIG. 6, described below, shows another embodiment of the electrolytic fluid antenna 10 where the nozzle 20 is positioned inside the aperture 22. The first current probe 12 may be positioned approximately where the electrolytic fluid 18 exits the nozzle 20 or, in other words, at the base of the stream 24. The nozzle 20 may be configured to direct the stream 24 in any direction. For example, the nozzle 20 may be configured to direct the stream 24 of electrolytic fluid 18 in a direction that is approximately opposite to Earth's gravitational field, as shown in FIGS. 1-5 and 8. Different stream 24 directions will produce different electrolytic fluid antenna 10 polarizations.

Figure 3:
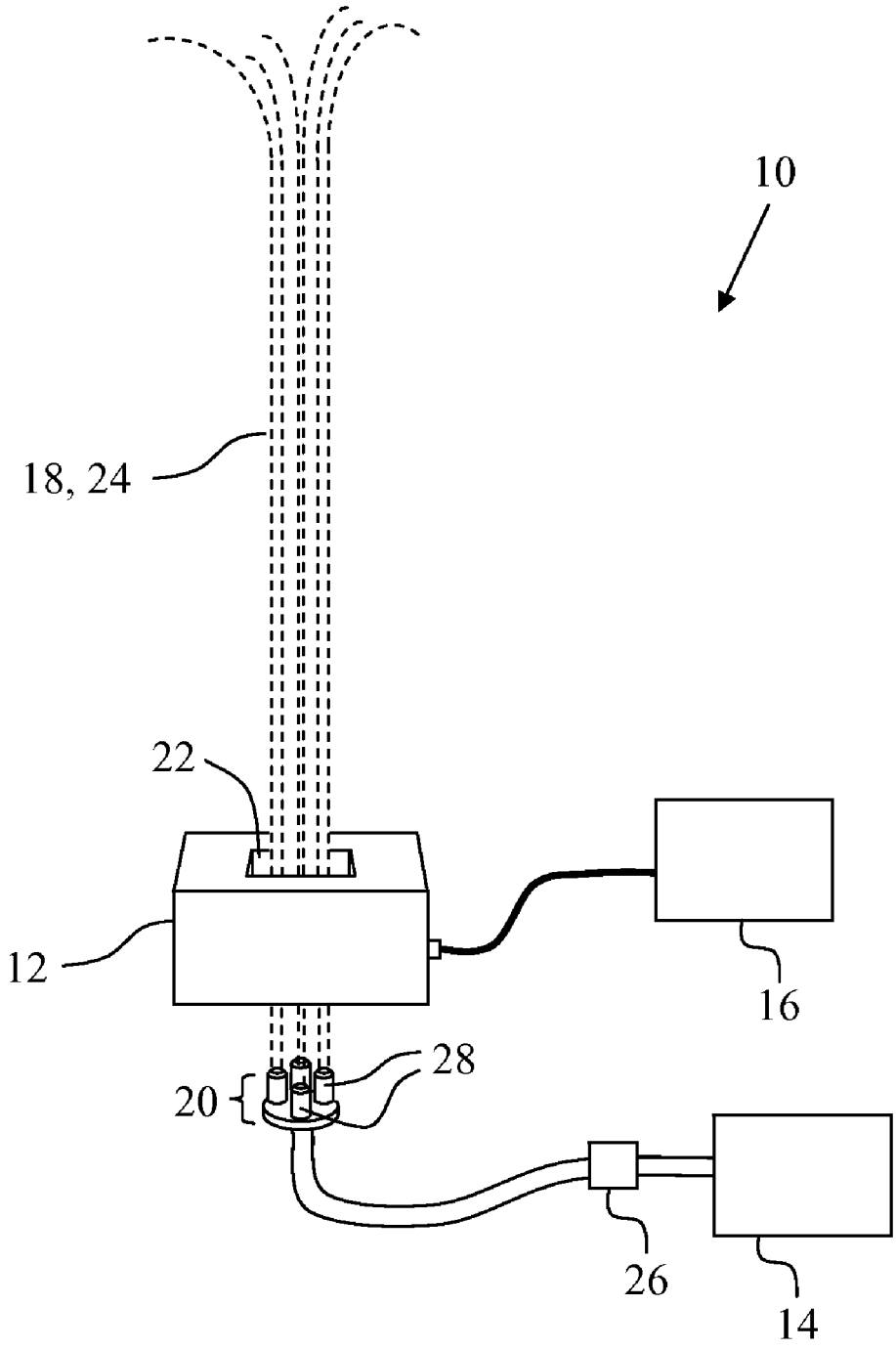
FIG. 3 is a perspective view of another embodiment of the electrolytic fluid antenna including a multi-head nozzle.

FIG. 3 shows an embodiment of the electrolytic fluid antenna 10 where the nozzle 20 comprises multiple heads 28. In the embodiment shown in FIG. 3, the multiple heads 28 are arranged such that the stream 24 is comprised of multiple sub-streams. The heads 28 may be arranged in any configuration. For example, the heads 28 may be arranged in a concentric ring configuration. The nozzle 20 may have any desired number of heads 28.

Figure 4:
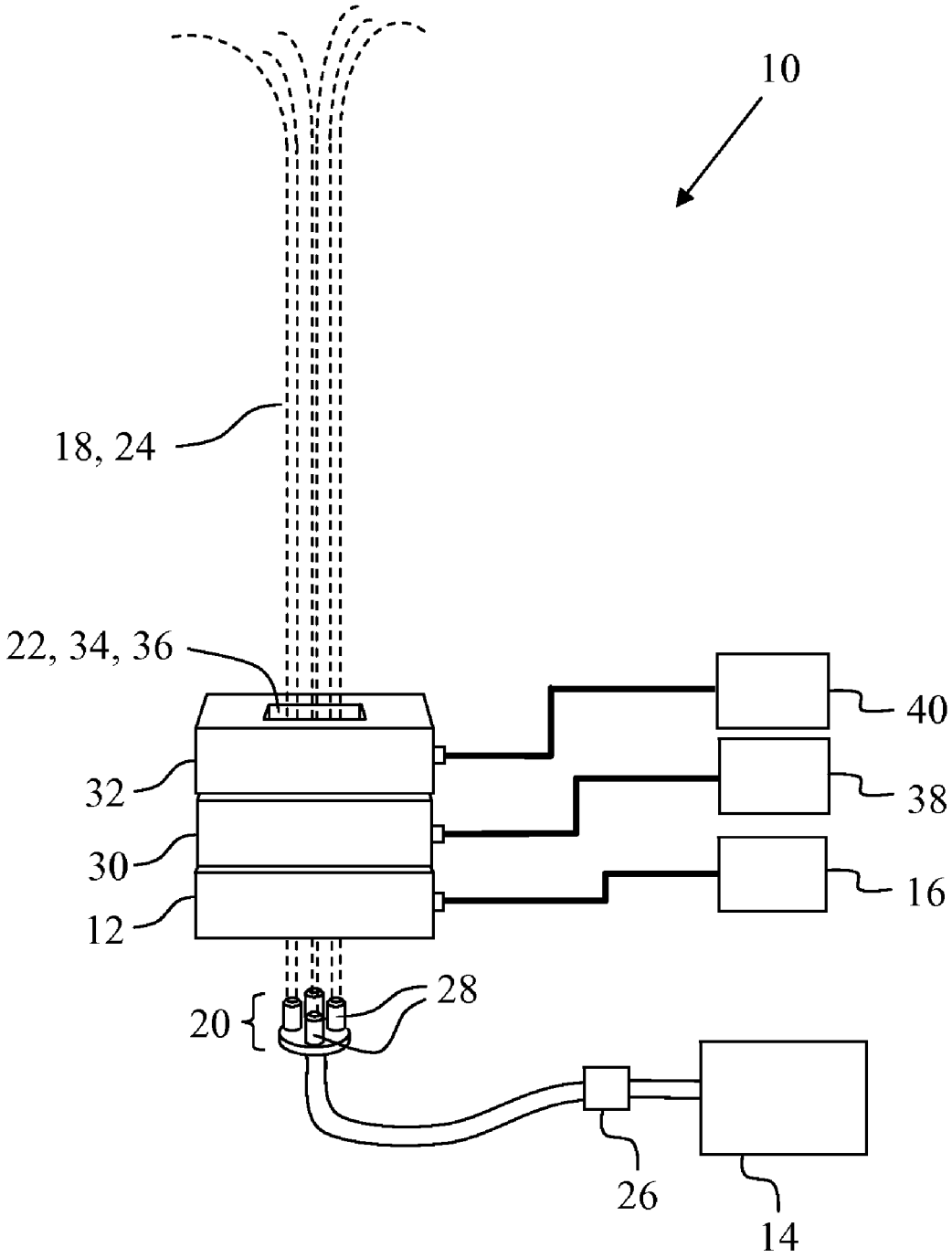
FIG. 4 shows a multi-band embodiment of the electrolytic fluid antenna.

FIG. 4 shows another embodiment of the electrolytic fluid antenna 10 with second and third current probes 30 and 32 respectively. The second and third current probes 30 and 32 each have an aperture 34 and 36 respectively. The first, second, and third apertures 22, 34, and 36 are approximately aligned with each other to allow the electrolytic fluid 18 to pass there through. As shown in FIG. 4, current probes 12, 30, and 32 are operatively coupled to respective transceivers 16, 38, and 40. Each current probe and corresponding transceiver combination may be configured to receive and transmit in a substantially different frequency band than the other current probe and transceiver combinations. For example, the first current probe 12 and the first transceiver 16 may be configured to transmit and receive electromagnetic signals within a high frequency (HF) band, the second current probe 30 and the second transceiver 38 may be configured to transmit and receive electromagnetic signals within a very high frequency (VHF) band, and the third current probe 32 and the third transceiver 40 may be configured to transmit and receive electromagnetic signals within an ultra high frequency (UHF) band.

Figure 5:
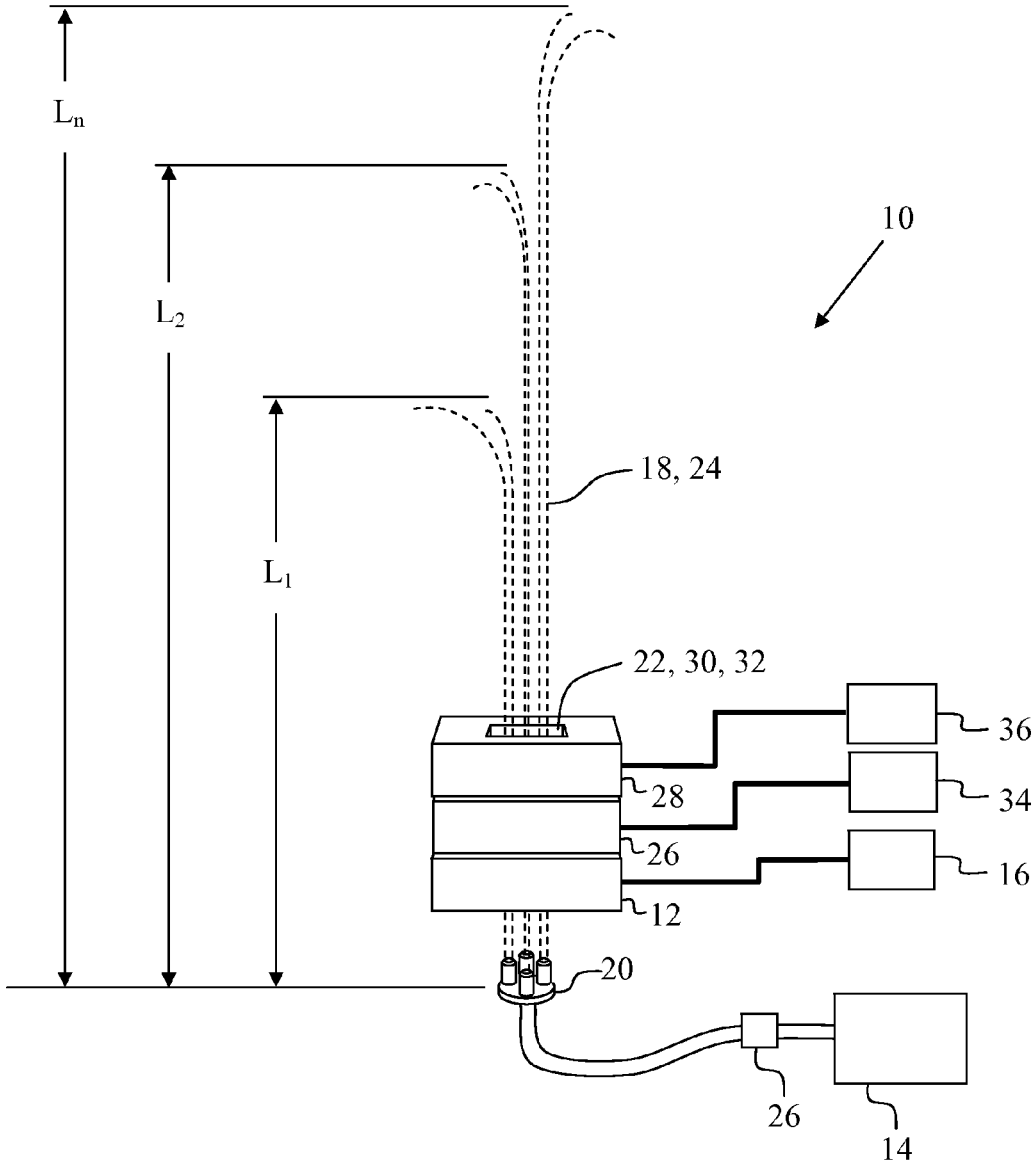
FIG. 5 shows an embodiment of the multi-band electrolytic fluid antenna with varying electrolytic fluid lengths.
Figure 6:
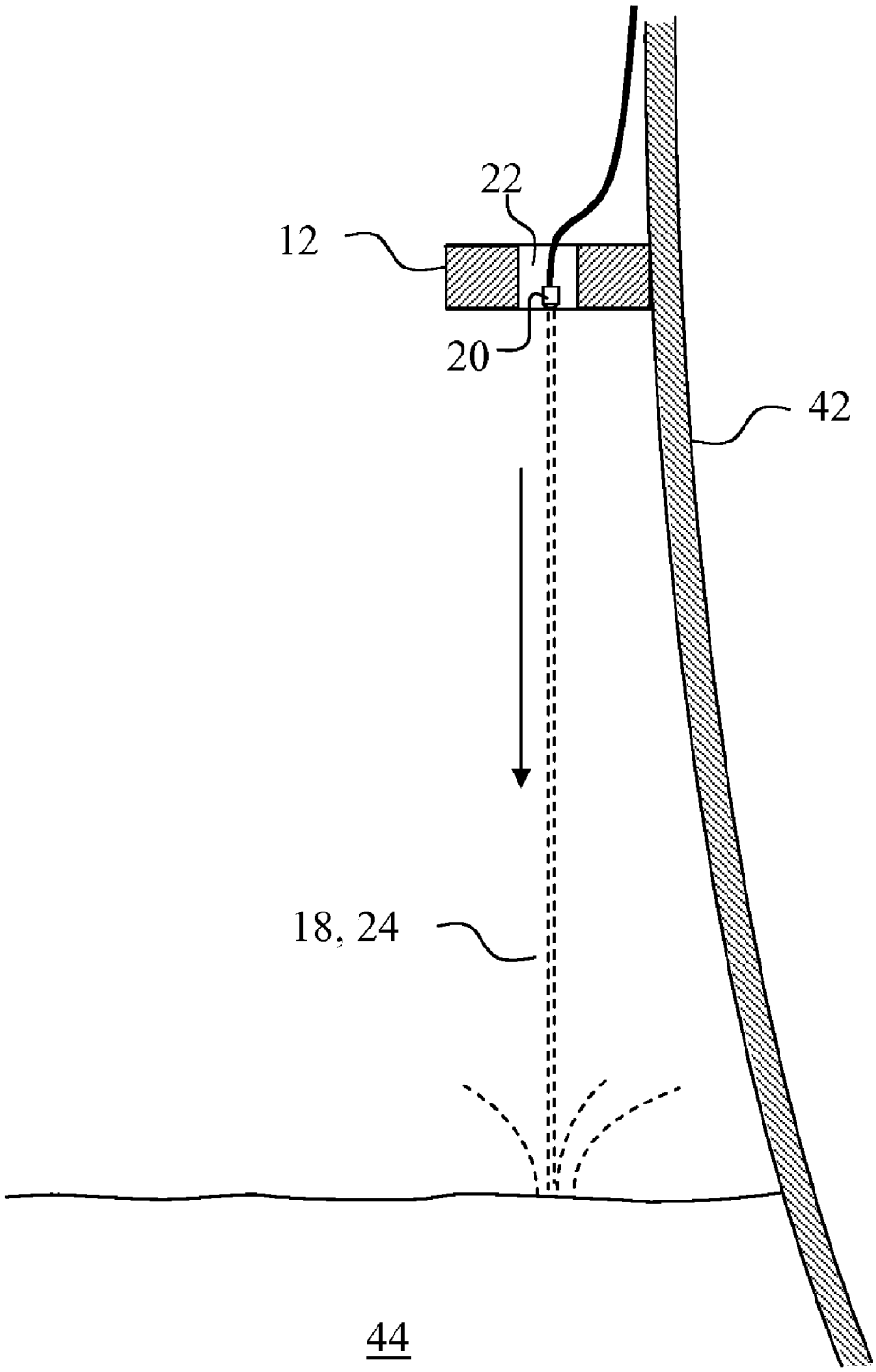
FIG. 6 is a cross-sectional view of the electrolytic fluid antenna.

FIG. 5 shows stream 24 with multiple sub-streams of different lengths $L_1$-$L_n$, where n is an index. Different sub-stream lengths produce different electrical lengths that cause different resonant frequency responses. For example, first, second, and third sub-stream lengths can be set to provide resonant frequency responses in the HF, VHF, and UHF bands respectively. The different sub-streams of stream 24 may be set to any desired length L. The different sub-stream lengths may be produced by altering the size and shape of the different heads 28 or by altering the pressure of the electrolytic fluid 18 at each of the heads 28. The resonant frequency response of the electrolytic fluid antenna 10 may be altered in real-time simply by altering the length of the stream 24 or one of its constituent sub-streams.

Figure 7:
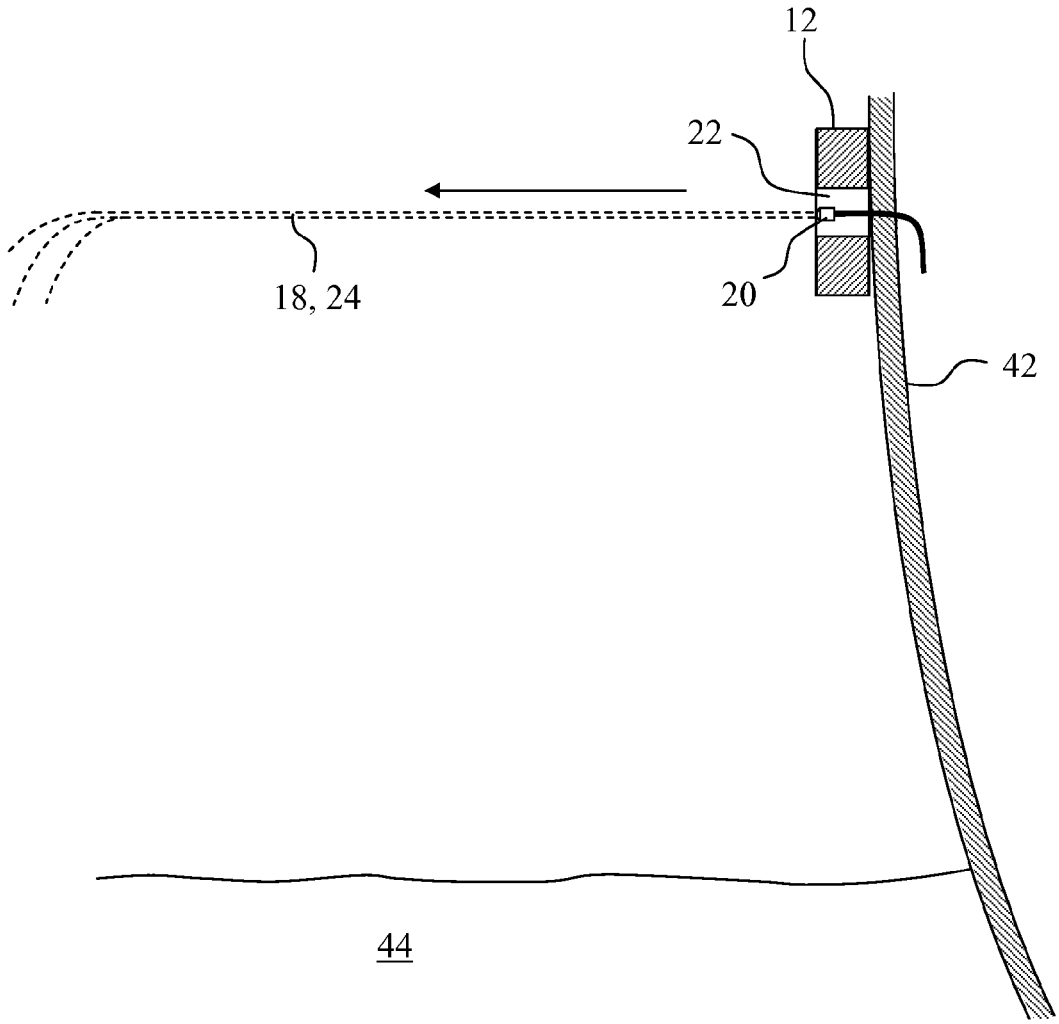
FIG. 7 is a cross-sectional view of an alternate orientation of the electrolytic fluid antenna.
Figure 8:
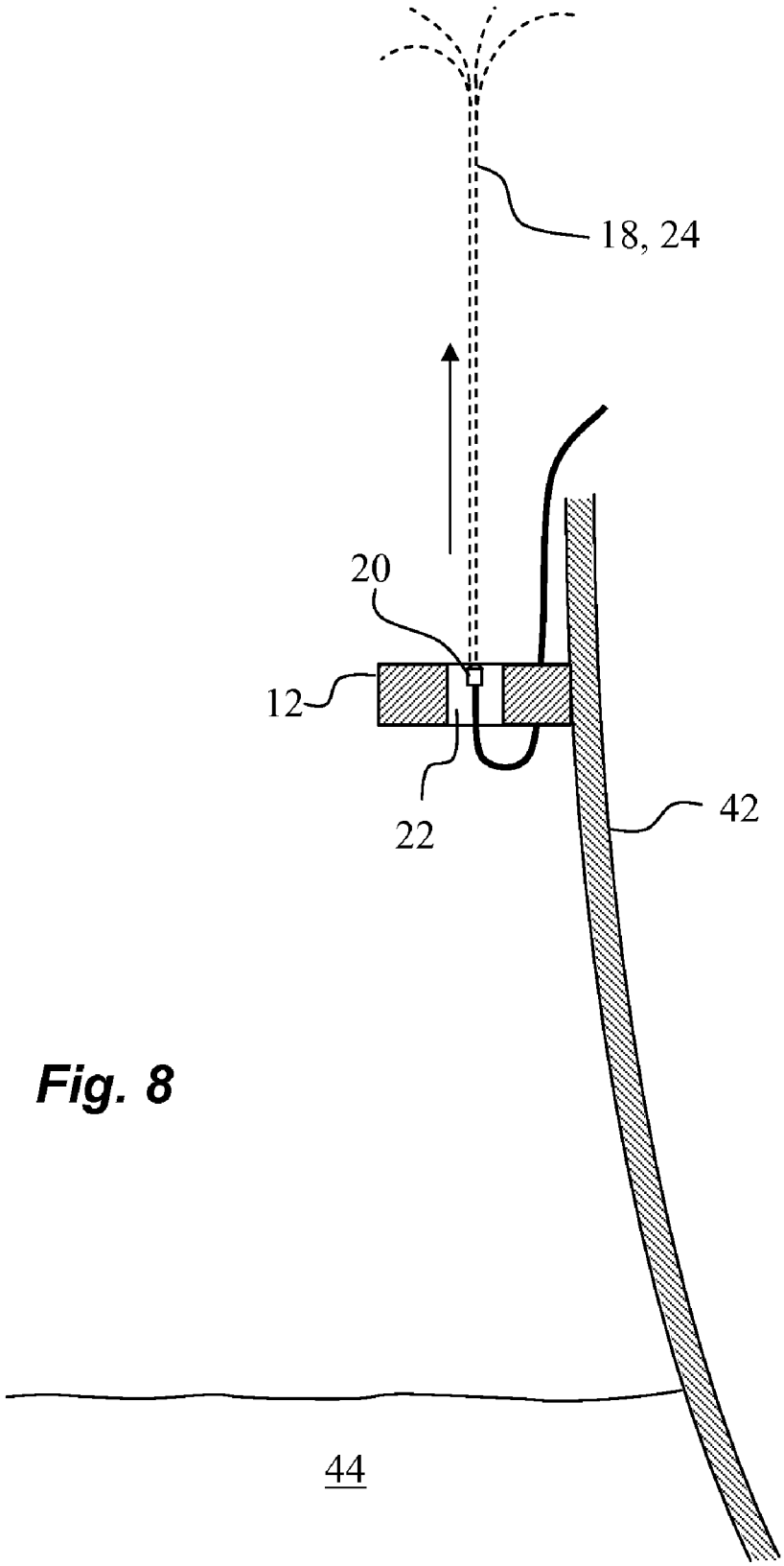
FIG. 8 is a cross-sectional view of an alternate orientation of the electrolytic fluid antenna.

FIGS. 6-8 are cross-sectional views of the electrolytic fluid antenna 10 showing the current probe 12 mounted to the side of a ship 42 afloat in a body of water 44. In the embodiment shown in FIG. 6, the nozzle 20 is positioned inside the aperture 22 and the stream 24 is directed downward, i.e. in the same direction as Earth's gravitational field. For clarity purposes, other elements described previously, such as the pump 14 and the first receiver 16 are not depicted in FIGS. 6-8. In one embodiment, the water 44 may be seawater that can be pumped by the pump 14 through the aperture 22 and back into the water 44. In the embodiment shown in FIG. 7, the stream 24 is directed outward, i.e. perpendicular to Earth's gravitational field. In the embodiment shown in FIG. 8, the stream 24 is directed upward, i.e. opposite to Earth's gravitational field.

Figure 9:
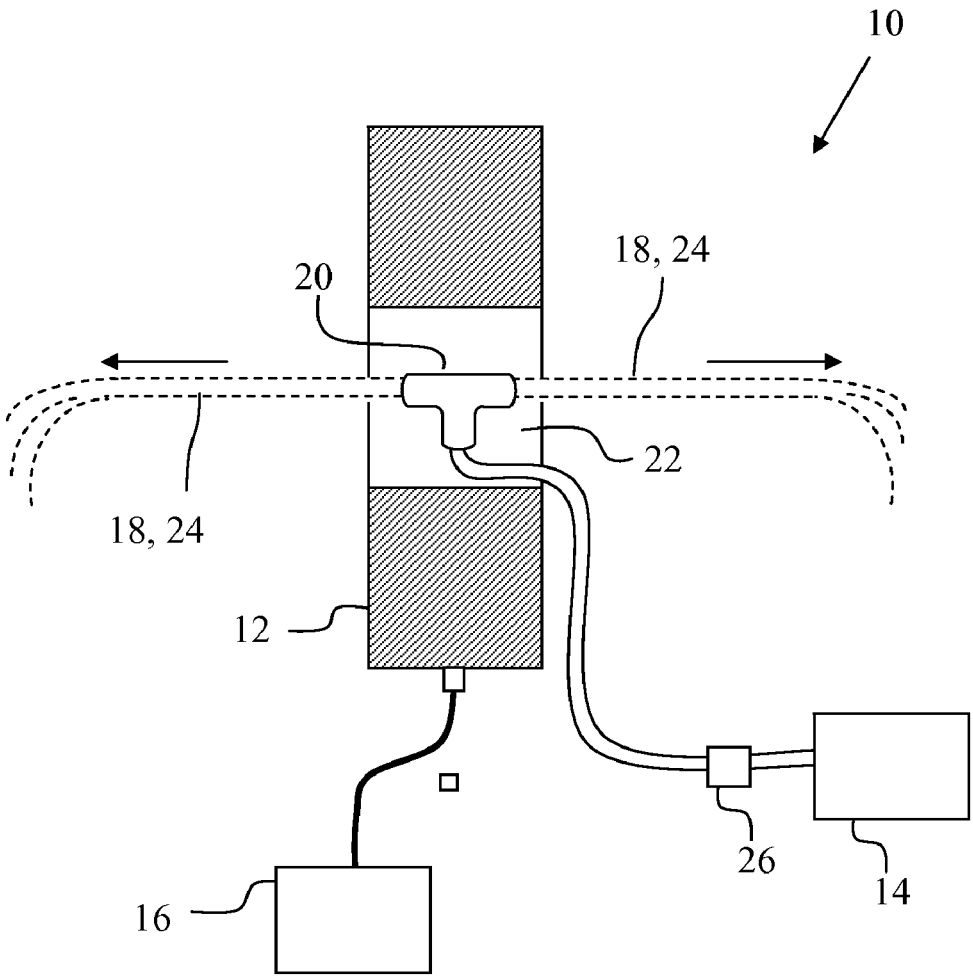
FIG. 9 is a cross-sectional view of a dipole embodiment of the electrolytic fluid antenna.

FIG. 9 is a dipole embodiment of the electrolytic fluid antenna 10 wherein the nozzle 20 is configured to produce two streams 24 of electrolytic fluid 18 both emanating from the current probe 12. A cross-section of the current probe 12 is shown so that the aperture 22 and the nozzle 20 can be clearly seen. In this embodiment, the electrolytic fluid antenna 10 functions as a ½-wavelength dipole antenna.

From the above description of the electrolytic fluid antenna 10, it is manifest that various techniques may be used for implementing the concepts of electrolytic fluid antenna 10 without departing from its scope. The described embodiments are to be considered in all respects as illustrative and not restrictive. It should also be understood that the electrolytic fluid antenna 10 is not limited to the particular embodiments described herein, but is capable of many embodiments without departing from the scope of the claims.

I claim:

1. An antenna comprising: a first current probe comprising a core of ferromagnetic material having an aperture therein; a pump comprising a nozzle, wherein the pump is configured to pump a free-standing stream of electrolytic fluid out the nozzle and through the aperture such that the stream and the current probe are magnetically coupled; and a first transceiver operatively coupled to the current probe; wherein the first current probe is positioned approximately where the electrolytic fluid exits the nozzle.

2. The antenna of claim 1, wherein the antenna is a monopole antenna.

3. The antenna of claim 1, further comprising a pressure regulator operatively coupled to the pump, wherein the pressure regulator is configured to alter the pressure of the electrolytic fluid between the pump and the nozzle.

4. The antenna of claim 3, wherein the electrolytic fluid is seawater.

5. The antenna of claim 1, wherein the nozzle is comprised of multiple heads such that the stream of electrolytic fluid is comprised of multiple sub-streams.

6. The antenna of claim 5, wherein the nozzle is positioned within the aperture and two heads direct free-standing sub-streams of electrolytic fluid out of opposite ends of the aperture thereby creating a dipole antenna.

7. The antenna of claim 1, wherein the nozzle is configured to direct the stream of electrolytic fluid in a direction that is approximately opposite to Earth's gravitational field.

8. The antenna of claim 1, wherein the nozzle is configured to direct the stream of electrolytic fluid in a direction that is approximately perpendicular to Earth's gravitational field.

9. The antenna of claim 1, wherein the nozzle is adjustably configured to direct the stream of electrolytic fluid in any direction.

10. A method for providing a transmitting/receiving antenna comprising: operatively coupling a current probe comprising a ferromagnetic core having an aperture therein to a transceiver; pumping a free-standing stream of electrolytic fluid through the aperture to effectively create an antenna; and further comprising positioning the current probe at approximately the base of the stream.

11. The method of claim 10, wherein the electrolytic fluid is seawater.

12. The method of claim 10, wherein the stream of electrolytic fluid is comprised of multiple separate sub-streams, each sub-stream having a different length.

13. The method of claim 10, further comprising altering a resonant frequency response of the antenna by altering the length of the stream.

14. The method of claim 10, wherein the stream of electrolytic fluid effectively creates a monopole antenna.

15. The method of claim 10, wherein the pumping step further comprises pumping the electrolytic fluid through a bi-directional nozzle positioned within the aperture such that free-standing streams of electrolytic fluid extend out of opposing ends of the aperture thereby effectively creating a dipole antenna.

16. A sea water antenna comprising:

a first current probe comprising:

a core of ferromagnetic material having an aperture therein, a conductive, non-magnetic housing, and a primary winding comprising a single turn wrapped around core, through the aperture;

a nozzle positioned approximately within the aperture;

a pump hydraulically coupled to the nozzle, wherein the pump is configured to pump a free-standing stream of sea water out the nozzle and through the aperture such that the stream and the current probe are magnetically coupled; and a first transceiver operatively coupled to the primary winding and the housing.

* * * * *